United States Patent [19]

Meyer et al.

[11] 3,940,140

[45] Feb. 24, 1976

[54] VIBRATORY BOARD GAME APPARATUS

[75] Inventors: Burton C. Meyer, Downers Grove; Gordon A. Barlow, Skokie; Jeffrey D. Breslow, Highland Park, all of Ill.

[73] Assignee: Marvin Glass & Associates, Chicago, Ill.

[22] Filed: Dec. 30, 1974

[21] Appl. No.: 537,083

[52] U.S. Cl. ..... 273/109; 273/86 E; 273/134 B; 273/134 C; 273/138 A

[51] Int. Cl.[2] ..... A63F 3/00

[58] Field of Search ..... 273/86, 109, 110, 138

[56] References Cited

UNITED STATES PATENTS

| | | | |
|---|---|---|---|
| 1,951,051 | 3/1934 | Gueydan | 273/86 E |
| 2,392,547 | 1/1946 | Plebanek | 273/138 R |
| 2,400,261 | 5/1946 | Plebanek | 273/86 E |
| 3,463,495 | 8/1969 | Christensen | 273/110 |

FOREIGN PATENTS OR APPLICATIONS

| | | | |
|---|---|---|---|
| 1,473,311 | 2/1967 | France | 273/86 E |

*Primary Examiner*—Delbert B. Lowe
*Attorney, Agent, or Firm*—Coffee & Sweeney

[57] ABSTRACT

A vibratory board game apparatus including a plurality of playing pieces and a game board with a playing surface having a plurality of stations defining a confined playing piece path of travel. Some of the stations are destination stations having indicia representative of different locations. Simulated money is provided which may be acquired by having a playing piece stop on a given destination station. The game board mounts a selectively actuatable vibratory motor for vibrating the board and thereby moving all of the playing pieces simultaneously along the playing piece path of travel from one station to another.

18 Claims, 9 Drawing Figures

VIBRATORY BOARD GAME APPARATUS

BACKGROUND OF THE INVENTION

1. Field of the Invention

The present invention relates to board games and particularly to vibratory board games.

2. Brief Description of the Prior Art

Board games are well known in the art and generally include a game board with a playing surface having a plurality of stations printed thereon which define a playing piece path of travel. Playing pieces are provided to move from station to station. In most board games, the means for determining how much or how many stations a playing piece is to advance is a chance device of some kind, e.g., dice or a spinner.

Likewise, vibratory games per se are known in the art and generally include pieces which are movable over a surface in response to vibration. The vibration is usually generated by means of a vibratory motor, or the like, associated with the playing surface.

However, with the present invention, vibration is employed to produce movement of plural playing pieces along a defined path on a game board apparatus in an attempt to have the playing pieces stop at defined stations along the path.

SUMMARY OF THE INVENTION

It therefore is the principal object of the present invention to provide a board game apparatus wherein the playing pieces are movable over a playing piece path of travel in response to selectively actuatable vibratory drive means.

This and other objects are accomplished by one form of the invention currently contemplated which provides a plurality of playing pieces, at least one for each player of the game, and a game board. The game board includes a playing surface having a plurality of stations defining a playing piece path of travel bounded by side walls to confine the movement of the playing pieces. Some of the stations are destination stations having indicia thereon representative of different locations so that a player can attempt to have his playing piece or pieces stop at certain locations. Simulated money is provided which may be acquired by having a playing piece stop on a given destination station. Selectively actuatable vibratory drive means is mounted on the game board for moving all of the pieces simultaneously along the playing piece path of travel from one station to another.

DESCRIPTION OF THE PREFERRED EMBODIMENT

Figure 1:
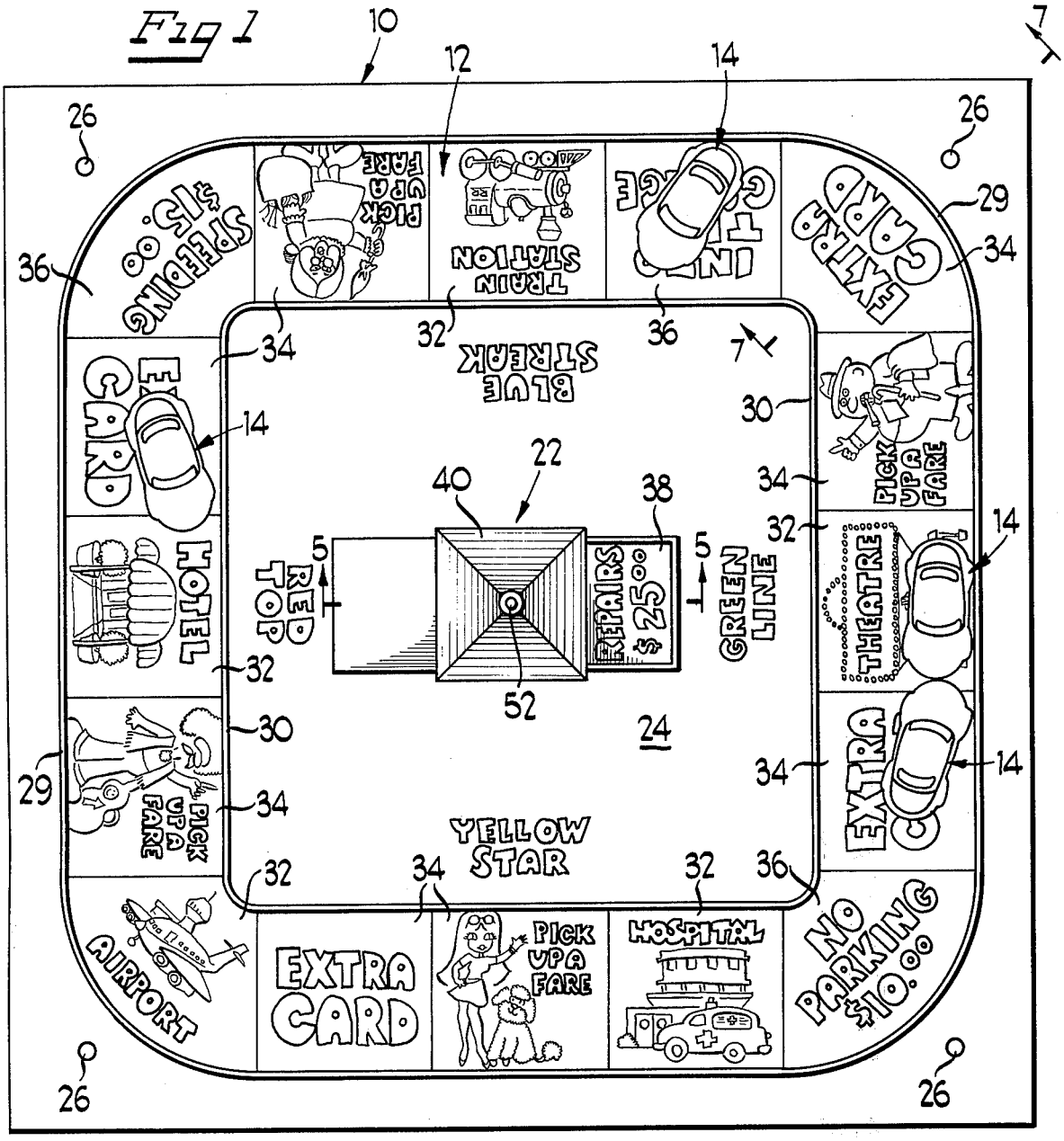
FIG. 1 is a top plan view of the game of the present invention.
Figure 2:
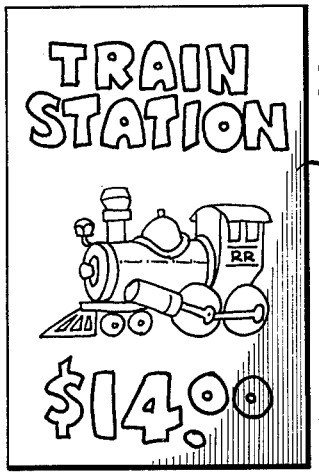
FIG. 2 is a plan view of one of the destination cards used in the present invention.
Figure 3:
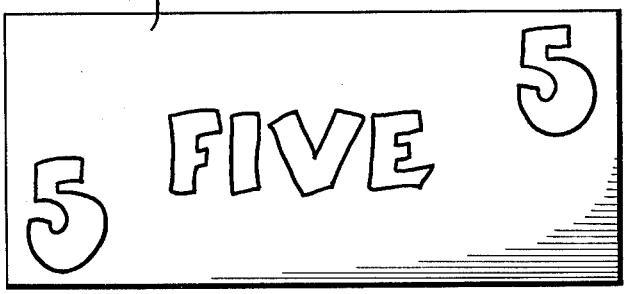
FIG. 3 is a plan view of one piece of simulated money used in the game of the present invention.
Figure 4:
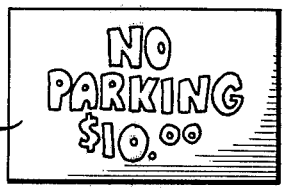
FIG. 4 is a plan view of one of the chance cards used in the game of the present invention.
Figure 8:
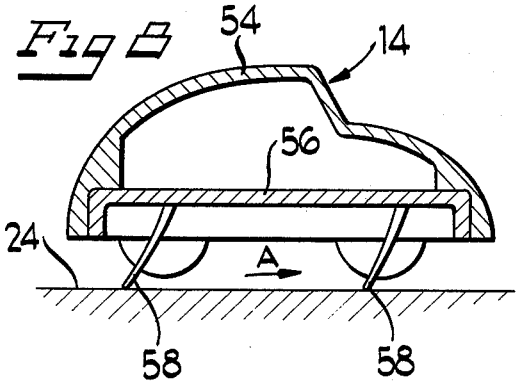
FIG. 8 is a front-to-rear central vertical sectional view of a playing piece used in the game of the present invention.
Figure 9:
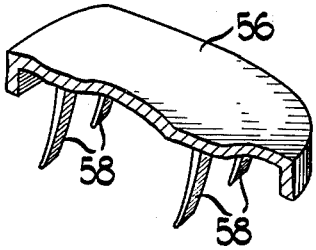
FIG. 9 is a perspective view partially in section of the base portion of the playing piece shown in FIG. 8.

Looking at FIG. 1, the game of the present invention is seen to generally include a game board, generally designated 10, having a playing piece path of travel, generally designated 12, formed thereon. Four playing pieces, generally designated 14 (FIGS. 1 and 8), are provided and are supported on the playing piece path of travel 12 for movement in response to vibration of the board. Also provided in the game of the present invention is simulated money 16 (one piece of which is shown in FIG. 3), a set of destination cards 18 (one of which is shown in FIG. 2), and a set of chance cards 20 (one of which is shown in FIG. 4). Vibratory drive means, generally designated 22 (FIGS. 1, 5 and 6), is provided to vibrate the game board 10 and move the playing pieces along the playing piece path of travel 12.

Figure 7:
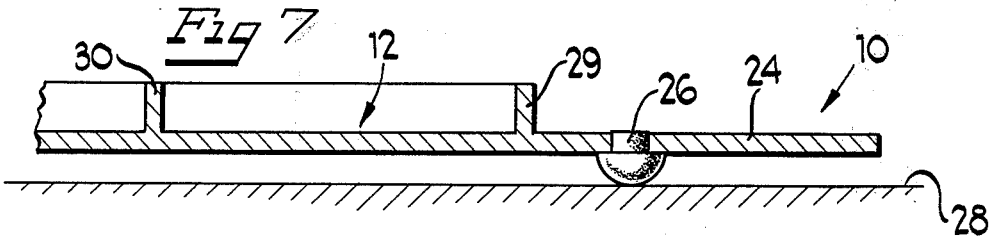
FIG. 7 is a fragmented vertical sectional view taken generally along the line 7—7 of FIG. 1.

The game board 10 has an upper surface 24 and is supported at the bottom thereof by four resilient support bumpers 26 (FIGS. 1 and 7) which depend from the underside of the game board at the four corners thereof and four depending support posts 27 located beneath the drive means 22. The bumpers 26 and posts 27 engage a floor, table or other suitable support surface 28.

The playing piece path of travel 12 is located between two upstanding generally parallel walls or rails 29 and 30 formed on surface 24. Walls 29 and 30 serve to confine the playing pieces 14 therebetween for movement along the playing piece path of travel 12.

The playing piece path of travel 12 has indicated thereon "destination stations" 32, "chance stations" 34, and "hazard stations" 36. Each destination station 32 has indicia thereon representative of a given location such as a "hospital", a "theatre", a "train station", a "hotel", or an "airport".

The chance stations 34 have indicia thereon instructing a player whose playing piece 14 stops on that station to pick either a destination card 18 or a chance card 20. Those chance stations 34 which indicate "pick up a fare", instruct a player to pick a destination card. Those chance stations 34 that indicate "extra card" instruct a player to pick a chance card 20.

The hazard stations 36 have indicia thereon which instruct a player to suffer some disadvantage. For example, some of the hazard stations 36 indicate "speeding (fine) $15.00"; "no parking (fine) $10.00" or "into the garage". If a playing piece 14 lands on the hazard station 36 indicating "into the garage", the playing piece is placed in a repair station 38 located in the middle of the playing surface 24 adjacent the drive means 22. In order for a player to get out of the repair station during the game, he must pay $25.00.

Figure 5:
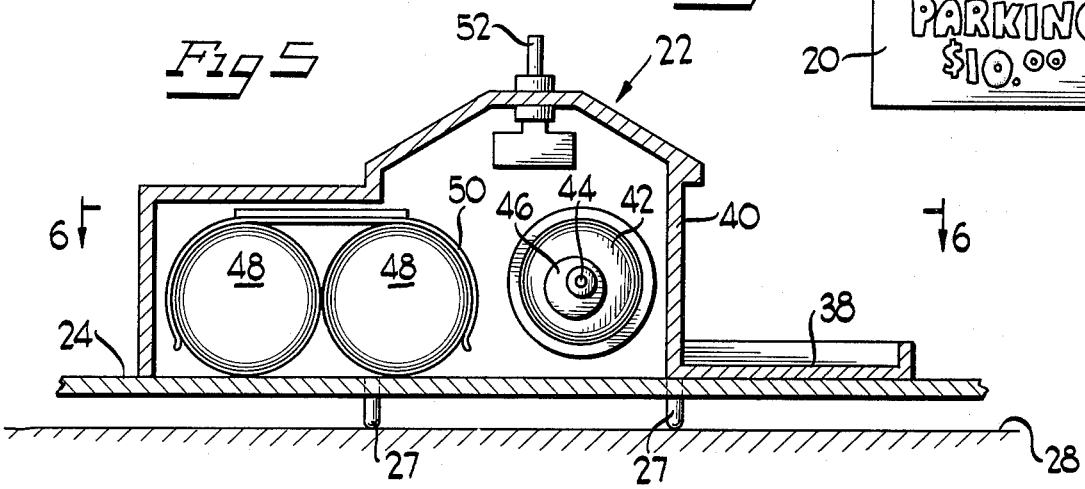
FIG. 5 is a fragmented vertical sectional view taken generally along the line 5—5 of FIG. 1.
Figure 6:
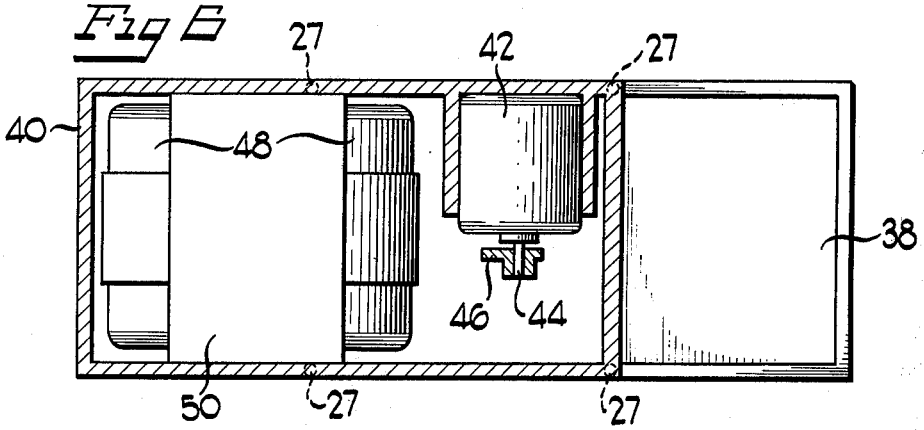
FIG. 6 is a horizontal sectional view taken generally along the line 6—6 of FIG. 5.

Looking at FIGS. 1, 5 and 6, the drive means 22 includes a housing 40 in the form of a simulated taxi stand having a vibratory motor 42 mounted therein. The motor 42 has a drive shaft 44 with an eccentric 46 mounted at the end thereof. The housing 40 also contains batteries 48 received in a suitable carriage 50 which are used to power the vibratory motor 42. A push button on-off switch 52 is mounted on top of the housing 40 to turn the motor on and off. When the drive means 22 is turned on, the game board 10 vibrates due to the motion of the eccentric 46.

Each playing piece 14 generally includes a housing 54 in the form of a simulated vehicle, such as a taxi cab. Each playing piece 14 is supported on the playing piece path of travel 12 and is movable therealong in response to the vibration generated by the drive means 22. To this end each playing piece 14 has a base 56 mounted within the housing 54 having a plurality of depending fingers 58 mounted thereon. The fingers are canted rearwardly of the vehicle so that when the game board 10 is caused to vibrate by the actuation of the drive means 22, the playing pieces 14 will move irregularly or randomly forwardly in the direction of arrow A (FIG. 8) over the playing piece path of travel 12.

The destination cards 18 have indicia thereon identical to the indicia of the destination stations 32. For instance, the card shown in FIG. 2 has the same indicia as the "train station" destination shown at the upper middle station in FIG. 1, and so on. In addition, the destination cards 18 will have the amount of the "fare" that a player is to collect if he successfully reaches or stops at that destination. But the player must hold that destination card to collect the fare.

The chance cards 20 (FIG. 4) have indicia thereon, identical to one of the hazard stations, which would either nullify a hazard as represented by a hazard station 36, give a player some other advantage or give a player the right to operate the push button 52 according to the rules of the game which will be discussed hereinafter.

The game can be played by two or more players. The game is commenced by giving each player a given amount of destination cards 18 which are held in secret. In addition, each player is given a certain amount of money 16. The players then take turns operating the push button 52 of the drive means 22 in an effort to move a playing piece 14 along the playing piece path of travel 12. The object is to have a player's playing piece 14 travel along the path of travel and stop at a destination station 32 which corresponds to one of that player's held destination cards 18. For example, if a player held a destination card 18 indicating "train station $14.00", that player, when it came to his turn, would push the button 52 to activate the drive means and keep the drive means activated until his playing piece 14 reached the destination station 32 indicating "train station", the same as his card. When he reaches that station, that player releases the button 52 to stop the motor. If that player successfully executes this movement, he is entitled to $ 14.00 from the "bank". However, it must be kept in mind that while it is one player's turn and his piece 14 travels on the playing piece path of travel 12, all of the other pieces 14 are likewise moving. Thus, it is possible that during one player's turn, another player may be transported to another station which could benefit or harm him. For example, a player's playing piece 14 can be transported to a destination station 32 corresponding to a destination card 18 he holds during another player's turn. Regardless of the fact it was the other player's turn, he is still entitled to collect his money for successfully arriving at his destination. Likewise, a player who is not operating the push button 52 can suffer a hazard by ending up on a hazard station 36. There may be a situation wherein a player during his turn may choose to cause one of his opponents to suffer a hazard rather than collect money for himself, for instance when another player is running out of money.

As can be seen, during the course of the game, the players will accummulate money 16 by successfully reaching their destinations. The player with the most money at the end of the game is declared the winner.

We claim:

1. A board game apparatus, comprising:

a plurality of playing pieces, at least one for each player of the game;

board means including a playing surface having means defining a plurality of individual stations defining a playing piece path of travel, the stations extending along substantially the entire playing piece path of travel and at least some of the stations being destination stations having indicia representative of different locations; and manually selectively actuatable drive means associated with said pieces for stopping and starting the movement of all of said playing pieces simultaneously along the playing piece path of travel from one station to another in an attempt to have a player's or an opponent's playing piece stop at a particular station.

2. A board game apparatus, comprising:

a plurality of playing pieces, at least one for each player of the game;

board means including a playing surface having means defining a plurality of individual stations defining a playing piece path of travel, the stations extending along substantially the entire playing piece path of travel and at least some of the stations being destination stations having indicia representative of different locations;

manually selectively actuatable drive means associated with said pieces for stopping and starting the movement of all of said playing pieces simultaneously along the playing piece path of travel from one station to another in an attempt to have a player's or an opponent's playing piece stop at a particular station; and a set of destination cards which may be acquired during the course of the game, each destination card having location indicia thereon corresponding to the location indicia of at least one of said destination stations for awarding a player whose playing piece stops, after deactivating said drive means, at a destination station corresponding to a destination card held by that player.

3. The board game apparatus of claim 2 including simulated money which may be acquired by having a playing piece stop on a given destination station, and wherein said destination cards define the amount of money that is awarded by the playing piece stopping at the given destination station indicated on the card.

4. The board game apparatus of claim 1 wherein said stations include hazard stations having indicia representative of a hazard a player encounters when his playing piece stops thereat after said drive means is terminated.

5. The board game apparatus of claim 1 wherein said playing pieces are movable irregularly over said playing surface in response to vibration of the board means, and said drive means includes means for vibrating said playing surface.

6. The board game apparatus of claim 1 wherein said playing pieces have means associated with said drive means for moving in an irregular fashion along the playing piece path of travel.

7. The board game apparatus of claim 1 including wall means on either side of the playing piece path of travel for confining the playing pieces for movement therealong.

8. A board game apparatus comprising:

a plurality of playing pieces, at least one for each player of the game;

board means including a playing surface having a plurality of stations defining a playing piece path of travel, said stations including destination stations having indicia representative of different locations, hazard stations having indicia representative of a hazard encountered by a player, and chance stations having indicia instructing a player thereat to pick a card;

a set of destination cards which may be acquired during the course of the game having location indicia thereon corresponding to the different indicia of said destination stations and having indicia relating to monetary value that is awarded should a player's playing piece stop at the destination station corresponding to a destination card held by that player;

a set of chance cards which may be acquired by a player during the course of the game having indicia thereon corresponding to the indicia at said hazard stations and which nullify a hazard indicated on said hazard stations should a player's playing piece stop at a hazard stations should a player's playing piece stop at a hazard station corresponding to a hazard card held by that player;

simulated money which may be acquired by a player's playing piece stopping at a destination station and corresponding to a destination card held by that player according to the monetary value indicia on the card; and manually selectively actuatable drive means associated with said pieces for stopping and starting the movement of all of said playing pieces simultaneously along the playing piece path of travel from one station to another in an attempt to have a player's or an opponent's playing piece stop at a particular station.

9. The board game apparatus of claim 8 wherein said playing pieces are movable irregularly over said playing surface in response to vibration of the board means, and said drive means includes means for vibrating said playing surface.

10. The board game apparatus of claim 8 wherein said playing pieces have means associated with said drive means for moving in an irregular fashion along the playing piece path of travel.

11. The board game apparatus of claim 8 including wall means on either side of the playing piece path of travel for confining the playing pieces for movement therealong.

12. A board game apparatus comprising:

a plurality of playing pieces, at least one for each player of the game;

board means including a playing surface having a plurality of individual stations formed thereon over a substantial portion of the playing surface and at least some of said stations having instructional indicia thereon dictating play of the game should a player's playing piece stop on one of said stations; and manually selectively actuatable drive means operatively associated with said playing pieces for moving all of the playing pieces simultaneously over the board means in a random fashion and for starting and stopping the movement of the playing pieces in an attempt by the players of the game to have their own or their opponent's playing pieces stop at selected stations on the board means.

13. The board game apparatus of claim 12 wherein said drive means includes means for vibrating said playing surface to effect said random movement of the playing pieces thereover.

14. A board game apparatus, comprising:

a plurality of playing pieces, at least one for each player of the game;

board means including a playing surface having means defining a plurality of individual stations defining a playing piece path of travel, the stations extending along substantially the entire playing piece path of travel, at least some of the stations being destination stations having indicia representative of different locations, and at least some of the stations being hazard stations having indicia representative of a hazard a player encounters when his playing piece stops thereat;

manually selectively actuatable drive means associated with said pieces for stopping and starting the movement of all of said playing pieces simultaneously along the playing piece path of travel from one station to another in an attempt to have a player's or an opponent's playing piece stop at a particular station; and a set of chance cards which may be acquired during the course of the game, each chance card having indicia corresponding to the indicia of at least one of said hazard stations to nullify said hazard should the player hold the corresponding hazard card.

15. A board game apparatus comprising:

a plurality of playing pieces, at least one for each player of the game;

board means including a playing surface having a plurality of individual stations formed thereon over a substantial portion of the playing surface, at least some of said stations having indicia thereon;

manually selectively actuatable drive means operatively associated with said playing pieces for moving all of the playing pieces simultaneously over the board means in a random fashion and for starting and stopping the movement of the playing pieces in an attempt by the players of the game to have their own or their opponent's playing pieces stop at selected stations on the board means; and a set of playing cards each having indicia thereon corresponding to the indicia on at least one of said stations for awarding or penalizing a player whose playing piece stops on a station having indicia corresponding to the indicia on a card held by that player.

16. The board game apparatus of claim 2 wherein said playing pieces are movable irregularly over said playing surface in response to vibration of the board means, and said drive means includes means for vibrating said playing surface.

17. The board game apparatus of claim 14 wherein said playing pieces are movable irregularly over said playing surface in response to vibration of the board means, and said drive means includes means for vibrating said playing surface.

18. The board game apparatus of claim 15 wherein said playing pieces are movable irregularly over said playing surface in response to vibration of the board means, and said drive means includes means for vibrating said playing surface.

* * * * *